US006515248B2

(12) United States Patent
Imamura et al.

(10) Patent No.: US 6,515,248 B2
(45) Date of Patent: Feb. 4, 2003

(54) GAS CIRCUIT BREAKER

(75) Inventors: Masaoki Imamura, Hitachi (JP); Hideo Kawamoto, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/950,621

(22) Filed: Sep. 13, 2001

(65) Prior Publication Data

US 2002/0113040 A1 Aug. 22, 2002

(30) Foreign Application Priority Data

Feb. 22, 2001 (JP) ..... 2001-045997

(51) Int. Cl.[7] ..... H01H 33/88
(52) U.S. Cl. ..... 218/59; 218/43
(58) Field of Search ..... 218/57–59, 43, 218/60, 61, 62, 66, 76; 361/116

(56) References Cited

U.S. PATENT DOCUMENTS 5,723,840 A * 3/1998 Bojic et al. ..... 218/57
5,814,781 A * 9/1998 Koyanagi et al. ..... 218/60

FOREIGN PATENT DOCUMENTS

JP 8-195149 7/1996

* cited by examiner

*Primary Examiner*—Elvin Enad
*Assistant Examiner*—M. Fishman
(74) *Attorney, Agent, or Firm*—Mattingly, Stanger & Malur, P.C.

(57) ABSTRACT

In order to provide a gas circuit breaker capable of reducing a remarkable degradation of dielectric strength in the vessel caused by hot gas and which can be downsized, the present invention is characterized by a hot gas discharge mechanism of the movable opening/closing mechanism, which is designed to ensure that the hot gas separated and fed to a movable opening/closing mechanism is discharged from an exhaust outlet 19*b* toward the side opposite to the puffer chamber 26 of the gas discharge chamber 28 formed on the rear of the puffer chamber 26, and gas is discharged toward the inner surface of the vessel 4 through the exhaust outlet 23*b* after gas temperature and velocity have been interrupted by convection of the gas in the puffer chamber 26. This structure interrupts a remarkable degradation of dielectric strength in the vessel resulting from direct blowing of hot gas onto the inner surface of the vessel 4.

7 Claims, 4 Drawing Sheets

GAS CIRCUIT BREAKER

BACKGROUND OF THE INVENTION

The present invention relates to a gas circuit breaker installed in the substation, switching station or the like, and particularly to a puffer type gas circuit breaker for reducing the arc occurring between fixed and movable contacts by means of insulating gas.

When the movable contact of the puffer type gas circuit breaker is disconnected from the fixed contact, high-temperature plasma arc occurs in-between. This makes it necessary to blow compressed insulating gas to arc to interrupt it. In this case, insulating gas is heated by arc and turned into high-temperature gas (hot gas); then it is separated into two flows to be discharged to the fixed and movable sides.

The structure of discharging hot gas in the puffer type gas circuit breaker, particularly the structure of discharging on the movable side, is disclosed in the Official Gazette of Japanese application patent laid-open publication No. Hei08-195149, for example. According to this Official Gazette, the structure of discharging gas on the movable side is designed in such a way that hot gas flowing through the hollow portion of the movable shaft is discharged almost perpendicularly toward the inner surface of the vessel from the exhaust outlet of the movable shaft through the exhaust outlet of the puffer piston.

To avoid serious deterioration of dielectric strength in the vessel due to direct blowing of hot gas onto the inner surface of the vessel, the puffer type gas circuit breaker of the above-mentioned gas discharge structure adopts the following measures: A cylindrical shield is provided between the exhaust outlet of the puffer piston and the inner surface of the vessel. Alternatively, a large-diameter vessel is used to increase the distance from the exhaust outlet of the puffer piston to the inner surface of the vessel.

There has been growing requirements for downsizing of the gas circuit breaker in recent years because of cost reduction arising from price competition, interrupted site of an electric power station, or interrupted installation area resulting from increased demands for application to the underground electric power station. The puffer type gas circuit breaker having the above-mentioned gas discharge structure, however, cannot not be downsized due to interference by the shield. Accordingly, a puffer type gas circuit breaker is required to prevent remarkable degradation of dielectric strength in the vessel even if this shield is eliminated.

SUMMARY OF THE INVENTION

The representative object of the present invention is to provide a gas circuit breaker which can interrupt a remarkable degradation of dielectric strength in the vessel caused by hot gas and which can be downsized.

MEANS FOR SOLVING THE PROBLEMS

The gas circuit breaker according to the present invention is characterized by having a hot gas discharge structure which is designed to ensure that the hot gas discharged by flowing through the hollow portion of the shaft, after having been separated and fed to the movable side is discharged into the inner surface of the vessel after gas temperature and velocity have been interrupted by convection of the gas.

The gas circuit breaker according to the present invention is provided with the first and second exhaust outlets whereby gas discharged into the gas exhaust chamber is dispersed and discharged into the space between the inside of the vessel and the outside of the gas exhaust chamber.

The gas circuit breaker according to the present invention has an exhaust outlet arranged in the gas exhaust chamber, and is characterized in that gas discharged from this exhaust outlet is discharged in a slanting direction into the space between the inside of the vessel and the outside of the gas exhaust chamber.

According to this hot gas discharge structure, the hot gas flowing to the insulating rod side through the hollow portion of the shaft after having been separated and fed to the movable side is discharged into the gas discharge chamber. Hot gas is transferred into the gas exhaust chamber, and the temperature and velocity are interrupted. Hot gas with the temperature and velocity interrupted flows toward the first and second exhaust outlets, and is discharged into the inner surface of the vessel. Hot gas with interrupted temperature and velocity is discharged from the first and second exhaust outlets, and, at the same time, it is possible to control the amount of the hot gas to be blown directly onto the inner surface of the vessel. This, in turn, interrupts a remarkable degradation of the dielectric strength in the vessel.

Since the exhaust outlet is arranged as described above, the distance from the exhaust outlet to the inner surface of the vessel can be increased, and the amount of the hot gas to be blown directly onto the inner surface of the vessel can be controlled. This allows a remarkable degradation of dielectric strength in the vessel to be interrupted further.

DETAILED DESCRIPTION OF THE PREFERRED EMBODIMENTS

Figure 1:
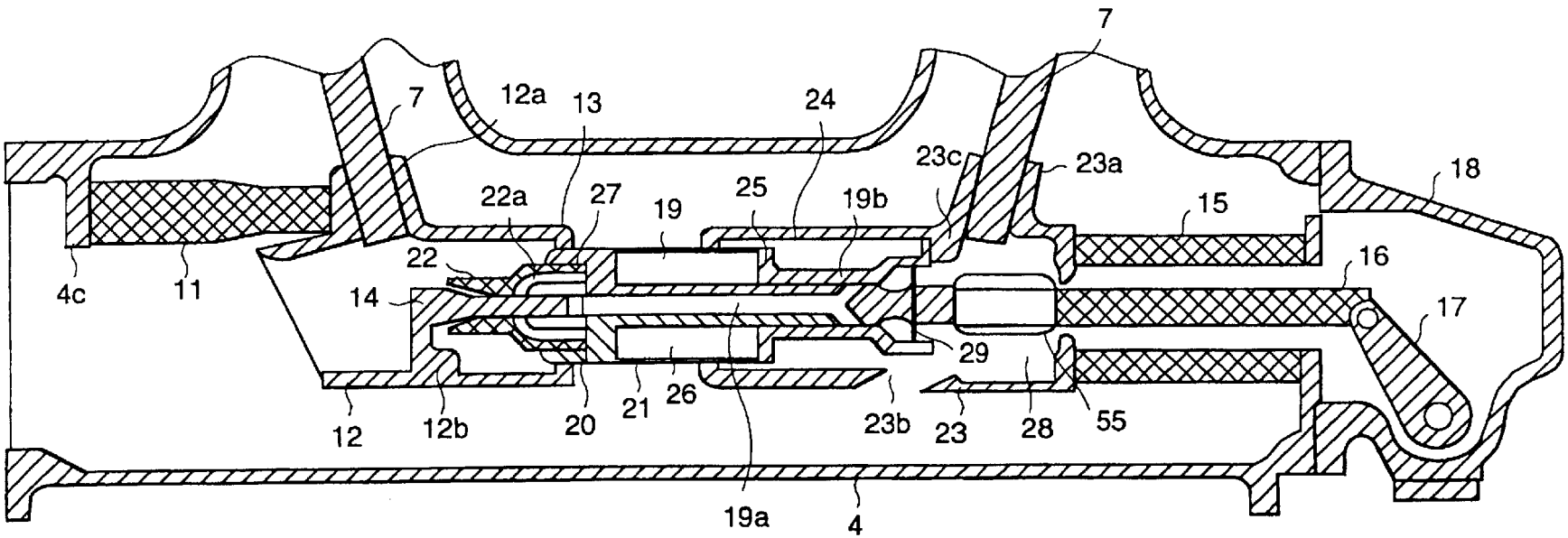
FIG. 1 is a cross sectional view representing the internal structure of the circuit breaking unit.
Figure 2:
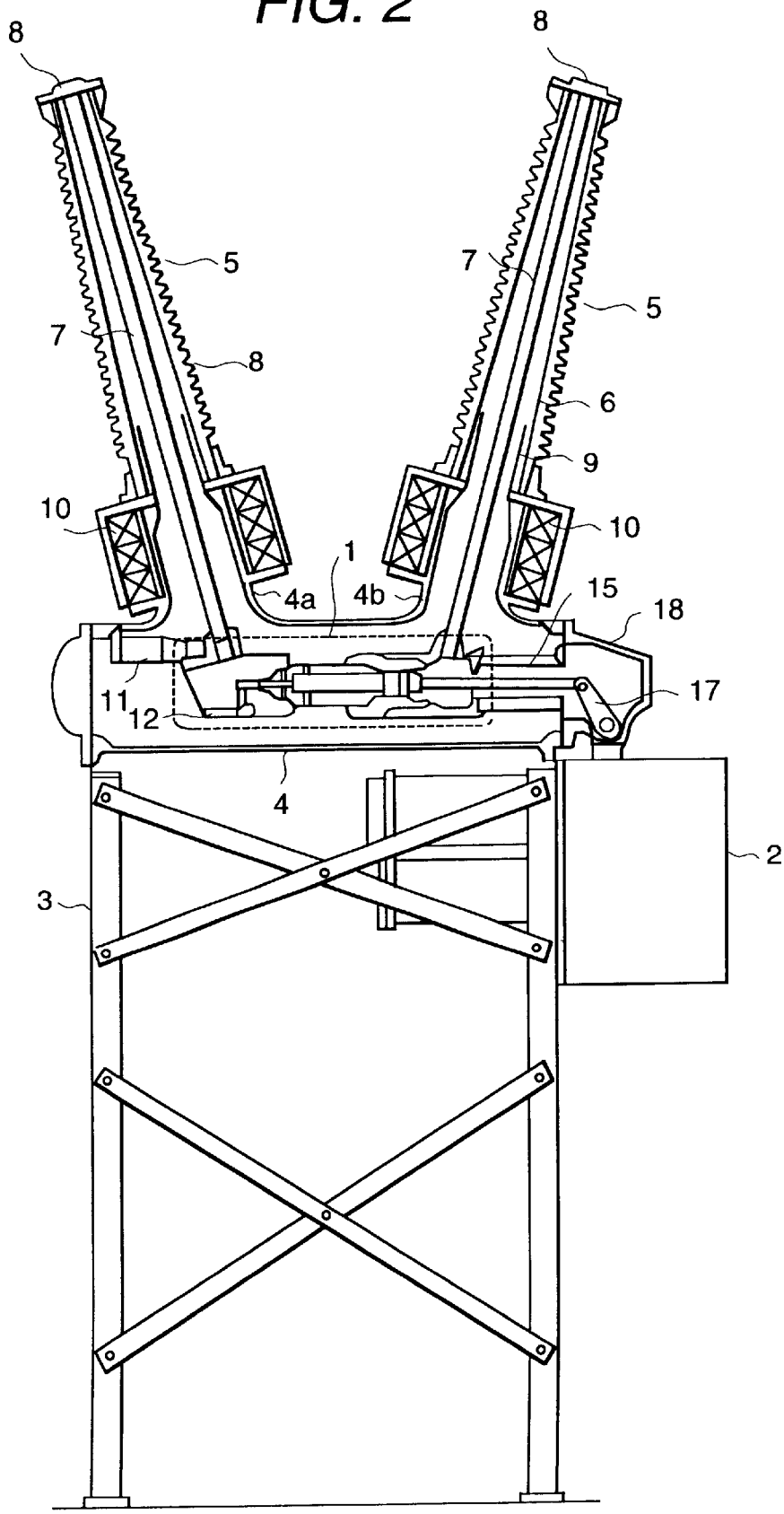
FIG. 2 is a partial cross sectional view representing the overall configuration of the circuit breaker as one embodiment according to the present invention.
Figure 3:
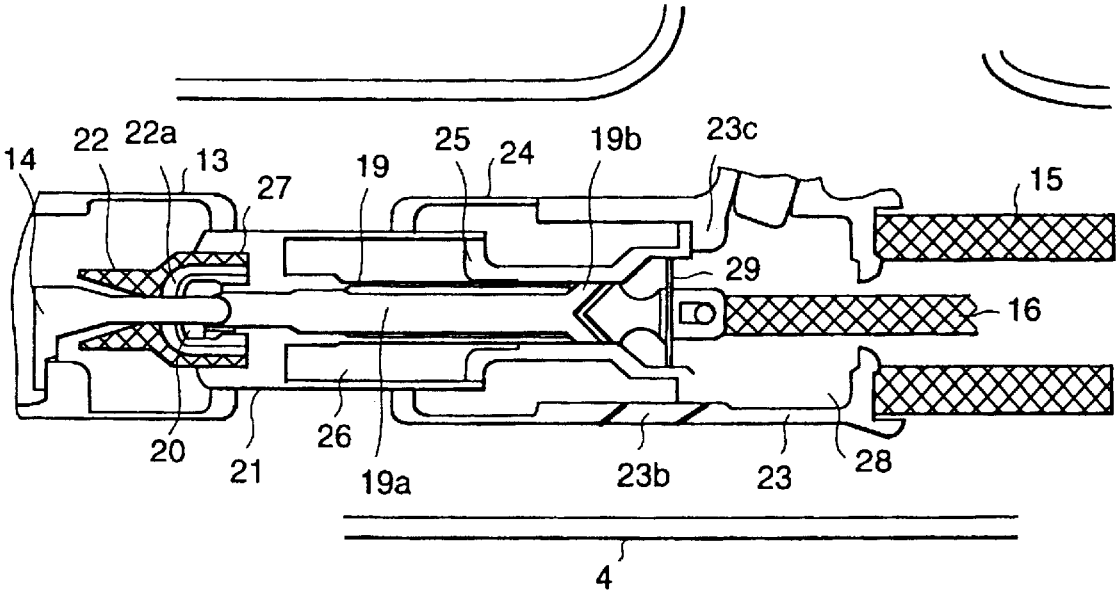
FIG. 3 is a drawing illustrating the operation of the circuit breaker as one embodiment according to the present invention, and showing the closed status where the fixed main contact is contact with the movable main contact, and the fixed arc contact is contact with the movable arc contact.

The following describes the embodiments according to the present invention with reference to drawings:

FIGS. 1 to 3 show the configuration of a puffer type gas circuit breaker representing a first embodiment of the present invention. The circuit breaker of the present embodiment is designed in a so-called isolated phase type structure where the circuit breaking unit is separated for each of three phases. Numeral 3 in the figures denotes a frame. The circuit breaking units 1 for three phases are arranged on the top of the frame 3. An operation mechanism 2 for operating the opening/closing mechanism of the circuit breaking units 1 for three phases in one operation is installed on one side of the frame 3.

The circuit breaking unit 1 consists of an operating opening/closing mechanism constituting the electric contact of a circuit breaker in a vessel 4 filled with sulfur hexafluoride (hereinafter referred to as "$SF_6$") gas as insulating gas and arc suppression gas. The vessel 4 is a metallic tank, and is connected to the ground through the frame 3. Branch points 4*a* and 4*b* protruding in an upward slanting direction are provided at two positions on the top of the horizontally placed oblong vessel 4. Bushings 5 are provided on the tips of branch points 4*a* and 4*b*.

The bushing 5 serves as a terminal for supplying electric current from the transmission line to the circuit breaking unit 1, or for sending electric current from the circuit breaking unit 1 to the transmission line. It consists of a central conductor 7 which leads from inside the vessel 4 and which is laid on the central shaft of a porcelain bushing insulator 6. The metallic terminal fitting 8 electrically connected to the incoming or outgoing cable which is electrically connected to both the central conductor 7 and transmission line is provided on the tip of the porcelain bushing isolator 6. An internal shield 9 for relieving electric field on the boundary between porcelain bushing insulator 6 and branch points 4*a* and 4*b* is installed between the porcelain bushing insulator 6 and central conductor 7 and on the lower side of the porcelain bushing insulator 6.

A current transformer 10 is installed on the circumference of the branch points 4*a* and 4*b* and between the bushing 5 and vessel 4. The interment current transformer 10 constitutes the detector of a measuring instrument for test the applied current of the central conductor 7. The applied current of central conductor 7 detected by the instrument current transformer 10 is input to the controller (not illustrated) of the circuit breaker. The controller of the circuit breaker determines according to the input current whether the circuit breaker is opened or closed, and sends a closing or opening command to the operation mechanism 2, thereby controlling the operation mechanism 2 to ensure that the electric contact of the circuit breaker turns on or off correctly.

The opening/closing mechanism installed in the vessel 4 is arranged in such a way that the fixed opening/closing mechanism installed on one side of the vessel 4 (left facing the drawing) through an insulated supporter 11 and the movable opening/closing mechanism mounted on the other side of the vessel 4 (right facing the drawing) through insulated supporter 15 are placed face-to-face with each other in the direction of central axis of the vessel 4.

The insulated supporter 11 is locked and held in position by a supporter 4*c*. A current carrying member 12 connected to the central conductor 7 is locked and supported on the opposite side of the supporter 4*c* of the insulated supporter 11.

The current carrying member 12 is a conductive cylindrical member. An upward protruding cylindrical conductor connector 12*a* is mounted on the top thereof. The central conductor 7 is inserted into the conductor connector 12*a* and the end opposite to the supporter 4*c* of the insulated supporter 11 is fixed in the conductor connector 12*a*.

According to the present invention, the conductor connector 12*a* is locked and supported by the insulated supporter 11; namely, the current carrying member 12 is locked and supported in the upper part of the central shaft of the vessel 4. Hot gas can be discharged into the space opposite to the movable opening/closing mechanism through the inner periphery of the current carrying member 12. Moreover, hot gas can be discharged so that it does not directly contact the insulated supporter 11. This allows effective discharge of hot gas on the side of the fixed opening/closing mechanism, and interrupts deterioration of insulation performances of the insulated supporter 11.

A fixed main contact 13 is provided on the tip of the current carrying member 12 on the side opposite to the insulated supporter 11. The fixed main contact 13 is an cylindrical contact electrode, and the tip on the side of the movable opening/closing mechanism protrudes inwardly in the radial direction. A supporter 12*b* protrudes inwardly in the radial direction from the inner peripheral surface of the current currying member 12. A fixed arc contact 14 is locked and held in position the supporter 12*b*. The fixed arc contact 14 is a rod-shaped contact electrode mounted on the central axis of the vessel 4 (or on the central axis of the fixed main contact 13). It extends from the supporter 12*b* to the tip of the fixed main contact 13.

The insulated supporter 15 is cylindrical and is locked and supported by the vessel 4. An end cover 18 is provided on the other end of the vessel 4.

A rotary shaft lever 17 connected to an insulation rod 16 and operation rod (not illustrated) extending from the operation mechanism 2 is arranged inside the end cover 18. The insulation rod 16 is arranged on the central axis of the vessel 4 and extends toward the side of the fixed opening/closing mechanism through the inner diameter side of the insulated supporter 15. It can be moved in the direction of the central axis of the vessel 4 (in the horizontal direction) by the drive force of the operation mechanism 2 through the operation rod and the rotary shaft lever 17. A movable shaft 19 is provided on the tip of the insulation rod 16 on the side of the fixed opening/closing mechanism. A hollow portion 19*a* extending in the direction of the central shaft of the vessel 4 is formed on the movable shaft 19.

A movable shaft 19 and a movable arc contact 20 movable in the direction of the central axis of the vessel 4 are provided on the top of the fixed opening/closing mechanism of the movable shaft 19. The movable arc contact 20 is a contact electrode, and is arranged in such a way that it can be connected or disconnected from the fixed arc contact 14 mounted face-to-face in the direction of the central axis of the vessel 4. In other words, this structure can put in the following way: When the movable shaft 19 moves toward the fixed opening/closing mechanism, the inner periphery of the movable arc contact 20 contacts the outer periphery of the fixed arc contact 14 sliding with each other. When the movable shaft 19 moves away from the fixed opening/closing mechanism, the inner periphery of the movable arc contact 20 is moved away from the outer periphery of the fixed arc contact 14.

A puffer cylinder 21 formed integral with the movable shaft 19 and movable in the direction of the central shaft of the vessel 4 is mounted on the outer periphery of the movable shaft 19. The puffer cylinder 21 is a conductive member made of an electrically conductive member, and is designed as a double sleeve comprising an outer wall (also called outer sleeve) and an inner wall (also called inner sleeve). A movable main contact 27 is mounted on the outer surface of the side end of the fixed opening/closing mechanism of the outer wall of the puffer cylinder 21. The movable main contact 27 is a contact electrode, and is designed in such a way that it can be connected and disconnected from the fixed main contact 13 installed face-to-face in the direction of the central shaft of the vessel 4. In other words, this structure can put in the following way: When the puffer cylinder 21 together with the movable shaft 19 moves toward the fixed opening/closing mechanism, the outer periphery of movable main contact 27 contacts the inner periphery of the fixed main contact 13 sliding with each other. When the puffer cylinder 21 together with the movable shaft 19 moves away from the fixed opening/closing mechanism, the outer periphery of the movable main contact 27 moves away from the inner periphery of the fixed main contact 13.

An insulation nozzle 22 is mounted on the tip of the puffer cylinder 21 on the side of the fixed opening/closing mechanism so as to cover the outer periphery of the movable arc contact 20. The insulation nozzle 22 is a cylindrical member and cooperates with the outer periphery of the movable arc contact 20 to form a flow path 22*a* leading the insulating gas discharged from the puffer cylinder 21 to the tip of the movable arc contact 20.

A current carrying member 23 connected with the central conductor 7 is provided on the tip of the insulated supporter 15 on the side of the fixed opening/closing mechanism. The current carrying member 23 is a cylindrical conductive member, over which a cylindrical conductive connector 23*a* is arranged in a upward protruding form. A central conductor 7 is inserted into the conductive connector 23*a*. An electric contact 24 is mounted on the tip of the current carrying member 23 on the side of the fixed opening/closing mechanism. The electric contact 24 is a cylindrical contact electrode, and the radial thickness is designed greater than that of other parts to ensure that the tip on the side of the fixed opening/closing mechanism protrudes inwardly in the radial direction. It is designed to contact the outer surface of the outer wall of the puffer cylinder 21 sliding with each other.

The top end of a puffer piston 25 on the side of the insulated supporter 15 is locked and supported by the supporter 23*c* protruding inwardly in the radial direction from the inner surface of the current carrying member 23. The puffer piston 25 is a cylindrical member, and the radial thickness is designed greater than that of other parts to ensure that its tip on the side of the fixed opening/closing mechanism protrudes outwardly in the radial direction. It is installed inside the puffer cylinder 21. The inner diameter of the puffer piston 25 on the side of the insulated supporter 15 is formed greater than that of other parts.

A puffer chamber 26 is formed on the outer periphery of the movable shaft 19 by the puffer cylinder 21 and puffer piston 25. When the puffer cylinder 21 acts on the fixed puffer piston 25, $SF_6$ gas as insulating gas is compressed in the puffer chamber 26. The insulating gas compressed in the puffer chamber 26 is discharged into the flow path. 22*a* through the exhaust outlet (not illustrated) which is provided on the insulation nozzle 22 side of the puffer chamber 26 and which penetrates the flow path 22*a* and puffer chamber 26, and is blown onto arc having occurred between the fixed arc contact 14 and movable arc contact 20 through the flow path 22*a*.

A gas discharge chamber 28 made of a current carrying member 23 and contact 24 is provided on the rear of the puffer chamber 26, namely, on the side of the insulated supporter 15. The hot gas having been separated and fed to the movable side is discharged into the gas discharge chamber 28 through the hollow portion 19*a* of the movable shaft 19. On the side of the insulation rod 16 of the movable shaft 19, exhaust outlets 19*b* through which hot gas flowing through the hollow portion 19*a* is discharged are formed at two radial positions in the vertical direction with respect to the horizontal surface. It is formed in a slanting direction to ensure that hot gas is discharged from the fixed mechanism toward the movable mechanism. The temperature and velocity of hot gas discharged into gas discharge chamber 28 are interrupted by convection of the gas. An exhaust structure on the movable side is designed to ensure the above-mentioned process, so that the gas is discharged into the inner surface of the vessel 4. Furthermore, on the side of the puffer chamber 26 of the peripheral wall located face-to-face with the inner surface of the vessel 4 of the current carrying member 23, opposite to where the inner diameter of the puffer piston 25 on the side of the insulated supporter 15 is greater than the inner diameter of other parts, exhaust outlets 23*b* for discharging hot gas inside the gas discharge chamber 28 to the inner side of the vessel 4 are arranged at four positions in the radial direction at intervals of 90 degrees. Hot gas is discharged from the movable mechanism to the fixed mechanism.

On the current carrying member 23, the gas exhaust outlet 55 is arranged in the horizontal direction, as described later.

Figure 4:
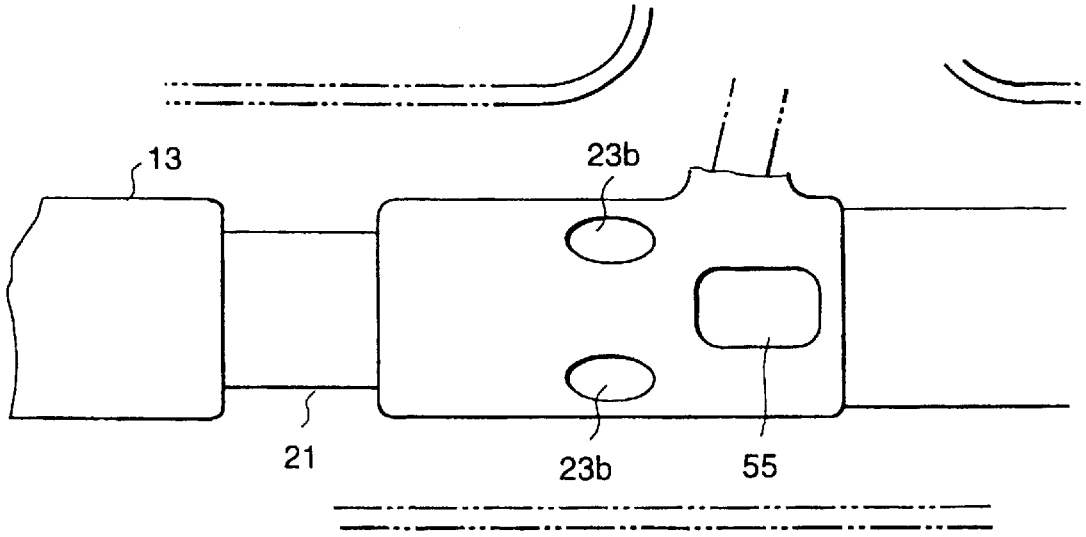
FIG. 4 is the same as FIG. 3 except that the vessel 4 is not included and it is viewed from the side.

The following describes the operations of the gas circuit breaker according to the present invention, particularly the operations ranging from the closed to open states:

FIG. 3 shows the closed state. FIG. 4 is the same as FIG. 3 except that the vessel 4 is not included and it is viewed from the side.

Under this condition, the fixed main contact 13 is in contact with the movable main contact 27, and the fixed arc contact 14 is in contact with the movable arc contact 20. Thus, the current fed into the circuit breaker from one side of the bushing 5, for example, from the fixed opening/closing mechanism flows from the metallic terminal fitting 8 and central conductor 7 to the fixed main contact 13 and fixed arc contact 14 through the current carrying member 12. The current flowing to the fixed main contact 13 and fixed arc contact 14 flows to the movable main contact 27 and the movable arc contact 20 in contact with the fixed main contact 13 and fixed arc contact 14. The current supplied to the movable main contact 27 and the movable arc contact 20 is led out of the circuit breaker from the puffer cylinder 21, contact 24 and the current carrying member 23 through the central conductor 7 and the metallic terminal fitting 8 on the other side of the bushing 5 (the movable opening/closing mechanism side). Under the conditions, the opening of the exhaust outlet 19*b* of the movable shaft 19 on the side of gas discharge chamber 28 is kept closed by the inner surface of the puffer piston 25.

In the gas discharge chamber 28, two gas exhaust outlets 55 are arranged at the positions opposite to each other in the horizontal direction. At the position 45 degrees away from the gas exhaust outlet 55, exhaust outlets 23*b* are arranged at four positions in the radial direction (in FIG. 3, the cross section of the exhaust outlet 23*b* is illustrated intentionally to ensure easy viewing of the shape).

If a fault current flows into the circuit breaker due to system contengancy, it is detected by the current transformer 10. This detection allows the controller of the circuit breaker to send the operation command for opening the circuit breaker to the operation mechanism 2. Then the operation mechanism 2 starts opening operation to allow an insulating rod 16 to move to the to the side opposite to the fixed opening/closing mechanism, and the circuit breaker starts to open.

Figure 5:
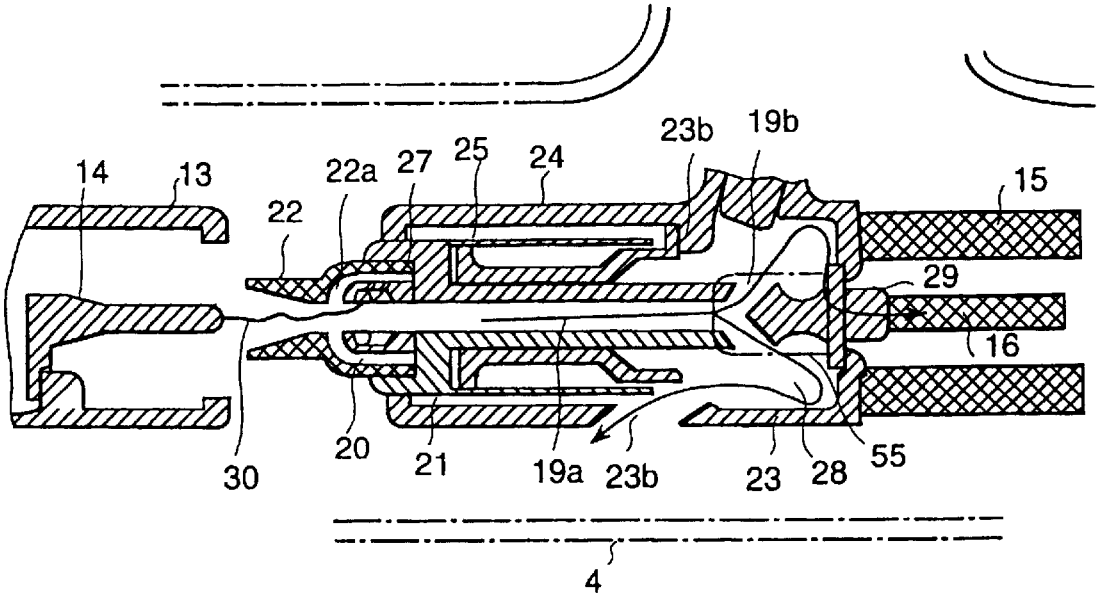
FIG. 5 is a drawing illustrating the operation of the circuit breaker as one embodiment according to the present invention, and showing the opened status where the movable main contact is separated from the fixed main contact and the movable arc contact is separated from the fixed arc contact.
Figure 6:
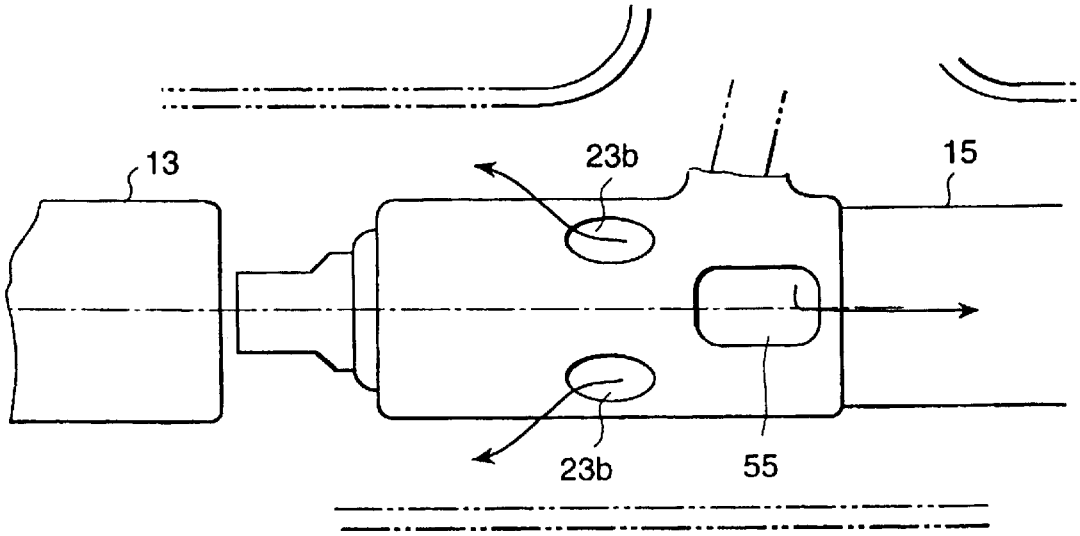
FIG. 6 is the same as FIG. 5 except that the vessel 4 is not included and it is viewed from the side.

FIG. 5 shows the open state. FIG. 6 is the same as FIG. 5 except that the vessel 4 is not included and it is viewed from the side (in FIG. 5, the cross section of the exhaust outlet 23*b* is illustrated intentionally to ensure easy viewing of the shape).

In the opening process, the movable main contact 27 is separated from the fixed main contact 13, and the fixed arc contact 14 is contact with the movable arc contact 20. In this case, the puffer cylinder 21 is located on the side of the movable opening/closing mechanism. Insulating gas is compressed in the puffer chamber 26.

When the insulating rod 16 moves to the side opposite to the movable opening/closing mechanism, the puffer cylinder 21 moves to the side of the movable opening/closing mechanism. This causes insulating gas in the puffer chamber 26 to be further compressed, and a higher gas pressure is reached. The opening of the exhaust outlet 19*b* of the movable shaft 19 on the side of the gas discharge chamber 28 moves to the insulated supporter 15, and gas is released.

When the movable arc contact 20 is separated from the fixed arc contact 14 as shown in FIG. 5, arc 30 occurs between the fixed arc contact 14 and movable arc contact 20. In this case, insulating gas compressed in the puffer chamber 26 is led to the position between the fixed arc contact 14 and the movable arc contact 20 through the flow path 22*a*, and is blown onto arc. Then arc is extinguished by this insulating gas.

Insulating gas having extinguished the arc turns into hot gas, and is separated and led into the fixed opening/closing mechanism and the movable opening/closing mechanism. In this case, the circuit breaker is completely open, namely, the fixed arc contact 14 is separated from the inner surface of the movable arc contact 20 as shown in FIG. 5.

Hot gas led to the fixed opening/closing mechanism is discharged to the space opposite to the movable opening/closing mechanism through the inner surface of the current carrying member 12.

In the meantime, the hot gas sent to the movable opening/closing mechanism flows through the hollow portion 19*a* of the movable shaft 19 to the side of the insulating rod 16, and is discharged into the gas discharge chamber 28 through the exhaust outlet 19*b*. In this case, the opening of the exhaust outlet 19*b* toward the gas discharge chamber 28 is produced in a slanting direction to form an acute angle with the hollow portion 19*a* of the movable shaft 19, and hot gas is discharged from the fixed opening/closing mechanism to the movable opening/closing mechanism.

The interior of the gas discharge chamber 28 and the inner periphery the insulated supporter 15 are connected with each other, as shown in FIGS. 1 to 3. Under the conditions shown in FIGS. 5 and 6, however, the opening of the current carrying member 23 on the side of the insulated supporter 15 is closed by an annular shut-off member 29 provided on the insulating rod 16. Accordingly, the hot gas discharged into the gas discharge chamber 28 does not flow to the inner side of the insulated supporter 15.

While the temperature and velocity are interrupted by convection in the gas discharge chamber 28, hot gas discharged into the gas discharge chamber 28 goes toward the current carrying member 23 and the gas exhaust outlet 55, and is discharged toward the inner surface of the vessel 4 from the exhaust outlet 23*b* and gas exhaust outlet 55. In this case, the exhaust outlet 23*b* is formed in a slanting direction to ensure that the opening on the side of the vessel 4 is located closer to the puffer chamber 26 than the opening on the side of the gas discharge chamber 28, so the hot gas with interrupted temperature and velocity is discharged toward the fixed opening/closing mechanism.

The gas exhaust outlet 55 is arranged at a position 90 degrees away from the exhaust outlet 19*b*. Accordingly, the hot gas coming out of the exhaust outlet 19*b* is not directly discharged from the gas exhaust outlet 55. It is discharged into the space between the insulated supporter 15 and the vessel 4.

According to the present embodiment, the hot gas fed to the movable opening/closing mechanism is discharged from the exhaust outlet 19*b* to the side opposite to the puffer chamber 26 of the gas discharge chamber 28 formed on the rear of the puffer chamber 26. After the temperature and velocity of gas have been interrupted by convection in the gas discharge chamber 28, the gas is discharged into the vessel 4 through the exhaust outlet 23*b* and the gas exhaust outlet 55. Previously, gas was discharged only from the gas exhaust outlet 55. Addition of the exhaust outlet 23*b* allows the amount of exhaust from the gas exhaust outlet 55 to be controlled. It also allows a remarkable degradation of dielectric strength to be controlled in the vessel 4 by direct blowing onto the inner surface of the vessel 4. This eliminates the use of a shield for preventing direct blowing of hot gas onto the inner surface of the hot gas, hence the diameter of the vessel 4 can be interrupted. This permits the gas circuit breaker to be downsized.

The present embodiment permits the hot gas with interrupted temperature and velocity to be discharged toward the fixed opening/closing mechanism through the exhaust outlet 23*b*. This makes it possible to interrupt the traveling distance of hot gas from the exhaust outlet 23*b* to the inner surface of the vessel 4, thereby reducing a direct blowing of hot gas onto the inner surface of the vessel 4. This further interrupts a remarkable degradation of dielectric strength in the vessel 4, whereby the diameter of the vessel 4 can be further interrupted, with the result that gas circuit breaker can be further downsized.

According to the present embodiment, two exhaust outlets 19*b*, two gas exhaust outlet 55 and four exhaust outlet 23*b* are arranged concentrically. These three types of exhaust outlets are arranged at different positions so that their positions do not overlap with one another. This makes it possible to increase the traveling distance of hot gas from the exhaust outlet 19*b* to the gas exhaust outlet 55 or the exhaust outlet 23*b*, hence to prolong the time of hot gas being subjected to convection in the gas discharge chamber 28. This further interrupts the remarkable degradation in dielectric strength in the vessel 4 due to direct blowing of hot gas onto the inner surface of the vessel 4. Accordingly, the diameter of the vessel 4 can be interrupted, hence the gas circuit breaker can be downsized.

According to the present invention, hot gas is discharged to the inner surface of the vessel after gas temperature and velocity have been interrupted by convection of the gas in the gas discharge chamber. This interrupts a remarkable degradation of dielectric strength in the vessel resulting from direct blowing of hot gas onto the inner surface of the vessel, without using a shield. This allows the diameter of the vessel to be interrupted, hence the gas circuit breaker to be downsized. Thus, the present invention provides a gas circuit breaker wherein the diameter of the vessel can be interrupted, hence the gas circuit breaker can be downsized.

What is claimed is:

1. A gas circuit breaker comprising:

a vessel containing insulating gas, a fixed contact installed inside said vessel, a movable contact installed face-to-face with said fixed contact so that it can be disconnected with said fixed contact, a shaft provided with a hollow portion to allow said movable contact to be moved by the force of an operation mechanism transmitted through an insulating rod, a puffer chamber provided outside said shaft to compress gas to be blown on an arc occurring between said fixed and movable contacts, an insulation nozzle for guiding to said arc the gas compressed in said puffer chamber, and a gas exhaust chamber provided on the rear of said puffer chamber; and wherein means are provided whereby the hot gas discharged from the hollow portion of said shaft is discharged into the inner side of said vessel after gas temperature and velocity have been interrupted by convection of the gas in said gas exhaust chamber.

2. A gas circuit breaker comprising:

a vessel containing insulating gas, a fixed contact installed inside said vessel, a movable contact installed face-to-face with said fixed contact so that it can be disconnected with said fixed contact, a shaft provided with a hollow portion to allow said movable contact to be moved by the force of an operation mechanism transmitted through an insulating rod, a puffer chamber provided outside said shaft to compress gas to be blown on an arc occurring between said fixed and movable contacts, an insulation nozzle for guiding to said arc the gas compressed in said puffer chamber, and a gas exhaust chamber provided on the rear of said puffer chamber; and wherein a first exhaust outlet is provided to discharge into the space between the inside of said vessel and the outside of said gas exhaust chamber the gas having been discharged into said gas exhaust chamber, and a second exhaust outlet is provided at a position closer to said puffer chamber than said first exhaust outlet of said gas exhaust chamber, whereby said second exhaust outlet discharges into the space between the inside of said vessel and the outside of said gas exhaust chamber the gas having been discharged into said gas exhaust chamber.

3. A gas circuit breaker according to claim 2 characterized in that said second exhaust outlet is arranged to ensure that gas in said gas exhaust chamber is discharged toward said fixed contact.

4. A gas circuit breaker according to claim 2 characterized in that four of said second exhaust outlets are arranged at an equally spaced interval around said gas exhaust chamber.

5. A gas circuit breaker comprising:

a vessel containing insulating gas, a fixed contact installed inside said vessel, a movable contact installed face-to-face with said fixed contact so that it can be disconnected with said fixed contact, a shaft provided with a hollow portion to allow said movable contact to be moved by the force of an operation mechanism transmitted through a insulating rod, a puffer chamber provided outside said shaft to compress gas to be blown on an arc occurring between said fixed and movable contacts, an insulation nozzle for guiding to said arc the gas compressed in said puffer chamber, a gas exhaust chamber provided on the rear of said puffer chamber, and an exhaust outlet arranged in said gas exhaust chamber; and wherein means are provided whereby the gas discharged into said exhaust outlet is discharged in a slanting direction into the space between the inside of said vessel and the outside of said gas exhaust chamber.

6. A gas circuit breaker according to claim 5 characterized in that a second exhaust outlet is provided in said gas exhaust chamber, and said second exhaust outlet is found at a position closer to the movable contact than said exhaust outlet as viewed from the fixed contact.

7. A gas circuit breaker according to claim 5 characterized in that four of said exhaust outlets are arranged at an equally spaced interval around said gas exhaust chamber.

* * * * *